US005700544A

United States Patent [19]

Goodwin et al.

[11] Patent Number: 5,700,544

[45] Date of Patent: *Dec. 23, 1997

[54] PROTECTIVE COVERS WITH WATER AND AIR IMPENETRABLE SEAMS

[75] Inventors: Brent I. Goodwin, Elkton, Md.; Francis J. Masley, Wilmington, Del.

[73] Assignee: W. L. Gore & Associates, Inc., Newark, Del.

[ * ] Notice: The term of this patent shall not extend beyond the expiration date of Pat. No. 5,569,507.

[21] Appl. No.: 490,155

[22] Filed: Jun. 14, 1995

Related U.S. Application Data

[63] Continuation-in-part of Ser. No. 396,300, Feb. 28, 1995, Pat. No. 5,569,507.

[51] Int. Cl.[6] ..... B32B 1/04

[52] U.S. Cl. ..... 428/76; 156/267; 156/269; 156/290; 156/291; 156/295; 428/68; 428/192; 428/143; 428/246; 428/252; 428/253; 428/284; 428/286; 428/421; 428/422

[58] Field of Search ..... 428/76, 68, 192, 428/193, 246, 252, 253, 284, 286, 421, 422; 156/267, 269, 290, 291, 295

[56] References Cited

U.S. PATENT DOCUMENTS

| | | | |
|---|---|---|---|
| 3,625,790 | 12/1971 | Ayres | 156/93 |
| 3,953,566 | 4/1976 | Gore | 264/288 |
| 3,962,153 | 6/1976 | Gore | 260/2.5 R |
| 4,096,227 | 6/1978 | Gore | 264/210 |
| 4,185,330 | 1/1980 | Stager | 2/164 |
| 4,187,390 | 2/1980 | Gore | 174/102 R |
| 4,194,041 | 3/1980 | Gore et al. | 428/315 |
| 4,532,316 | 7/1985 | Henn | 528/59 |
| 4,918,754 | 4/1990 | Leatherman et al. | 2/16 |

FOREIGN PATENT DOCUMENTS

| | | |
|---|---|---|
| 0410291 | 1/1991 | European Pat. Off. . |
| 0410292 | 1/1991 | European Pat. Off. . |
| 2737756 | 3/1979 | Germany . |
| 9000180 | 1/1990 | WIPO . |
| WO 91 12132 | 8/1991 | WIPO . |

OTHER PUBLICATIONS

Patent Abstracts of Japan, vol. 16, No. 425 (C–0982), 7 Sep. 1992 & JP A 04 146201 (Japan Gore Tex Inc.), 20 May 1992.

ASTM–ES22–92, "Emergency Standard Test Method For Resistance of Protective Clothing Materials to Penetration by Blood–Borne Pathogens Using Viral Penetration as a Test System[1, 2]".

*Primary Examiner*—James J. Bell

[57] ABSTRACT

The present invention is an improved protective cover for use in protecting a wearer against liquid contact, even under highly demanding conditions. The present invention identifies previously ignored voids in seams as a chief cause of failure in protective garments and other covers in shielding against air, liquid or virus penetration over an extended period of time. By sealing the seams with adhesive so as to fully encapsulate fibers therein and reduce void size to less than 10 micron, the risk leakage through the cover is dramatically reduced.

15 Claims, 4 Drawing Sheets

PROTECTIVE COVERS WITH WATER AND AIR IMPENETRABLE SEAMS

RELATED APPLICATIONS

The present application is a continuation-in-part of U.S. patent application Ser. No. 08/396,300 filed Feb. 28, 1995, U.S. Pat. No. 5,569,507.

BACKGROUND OF THE INVENTION

1. Field of the Invention

The present invention relates to garments and other covers used to protect against microscopic or sub-microscopic contaminants, such as viruses.

2. Description of Related Art

Conventional gloves made from silicone or other "rubber" elastomer have proven to be relatively good protective barriers. These products are quite impermeable to most contaminants and are inexpensive enough to be discarded after each use. However, rubber gloves have a number of deficiencies, including being impermeable to moisture vapor (making them very uncomfortable to wear for long periods of time), being subject to deterioration when exposed to certain chemicals or other adverse environmental conditions, and being prone to puncture and tears.

One answer to the uncomfortable nature of conventional rubber gloves is to employ gloves made from a waterproof and breathable material, such as expanded polytetrafluoroethylene (PTFE) made in accordance with U.S. Pat. No. 3,953,566 to Gore. Expanded PTFE as a membrane comprises a lattice of polymeric nodes and interconnected fibrils that creates an effective microporous barrier. This barrier repels water and other liquids while allowing moisture vapor to escape. A barrier of expanded PTFE has also been demonstrated to be quite effective at isolating contaminants, such as microorganisms.

Gloves, and glove inserts made from expanded PTFE and fabric composites are commercially available under the trademark GORE-TEX from W. L. Gore & Associates, Inc., Newark, Del. For many uses these gloves are considered to be the state-of-the-art in waterproof/breathable protection. Despite their effectiveness in a wide variety of applications, it has now been determined that at least certain gloves made from this composite do not consistently pass certain highly demanding tests, such as those for microbial protection. While these gloves are thoroughly waterproof through both the membrane and the seams, according to certain tests it has been determined that some penetration can occur through these gloves over an extended period of time. Further study has demonstrated that, although the composite material in these gloves does present a successful shield, surprisingly it is the seams of these gloves that are prone to leakage under heavy demands.

Conventional seams in expanded PTFE and fabric composites are generally formed by applying a bead of adhesive between fabric layers and sealing the seams together, sometimes under some elevated heat and pressure. Another approach in seam construction is to apply high heat and pressure to a polymeric coating so as to melt-flow and bond two layers together. Despite the effectiveness of these approaches in avoiding water penetration, it has been determined that these seams are not effective strong barriers to sub-microscopic contaminants, such as viruses suspended in a body fluid simulant (42±2 dynes/cm), or liquid over an extended period of exposure.

Previous glove inserts used in ski gloves and similar applications are not consistently airproof as measured by a "Whole Glove Leak Tester" (WGLT). While these inserts are waterproof as measured by a 5 minute dunk test (see ANSI/NFPA 1973 "Gloves for Structural Fire Fighting" test Chapter 5–12), and a 1 minute fill test, these inserts are not durably waterproof as measured by 1 hour wicking dye test.

Inserts used in military applications are airproof as measured by the WGLT and waterproof as measured by a 15 minute water fill test. However, these inserts are not durably waterproof as measured by the 1 hour wicking dye test.

Most recently, the United States has raised its standards for leakage protection, requesting that the glove should be able to pass a 24 hour wicking dye test. Until the present invention, no previous glove construction could assure compliance with such a rigorous standard.

Accordingly, it is a primary purpose of the present invention to provide an improved protective cover that is comfortable to wear yet provides a durable and highly effective barrier to air and water penetration.

These and other purposes of the present invention will become evident from review of the following specification.

SUMMARY OF THE INVENTION

The present invention is an improved protective cover for use in separating a wearer from the elements as well as sub-microscopic contaminants, such as viruses. The cover of the present invention comprises a composite material of microporous film that is attached to a fibrous (e.g., knit, woven, or non-woven) material. To produce a cover of a particular shape, such as a glove or bootie, the composite is sealed to itself along seams to make the desired shapes and then is cut to a particular shape. The sealing process of the seams has been determined to be particularly important, since a primary passageway for the leakage of air or water is through voids in the seams themselves. The seams of the present invention fully encapsulate fibers in the fibrous material with a continuous adhesive layer, reducing or eliminating any passageways therethrough. The encapsulation process of the present invention leaves typical voids of less than 10 microns in diameter.

Seams made in accordance with the present invention are not only airproof and waterproof, but also are resistant to penetration by viruses and similar contaminates. Unlike previous attempts to produce exceptionally sealed garments and other covers using expanded PTFE membranes and like material, the protective cover of the present invention will consistently pass the most vigorous of leakage tests, including a 24 hour wicking dye test.

The protective cover of the present invention retains all the features of expanded PTFE laminated garments, including waterproofness and breathability, while also stopping penetration of viruses.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved protective cover particularly suitable for use in environments where severe conditions require exceptionally durable waterproof and contamination resistant properties. While the cover of the present invention may comprise any desired shape and size, it is particularly intended to serve as a protective garment, such as a glove or boot.

Figure 1:
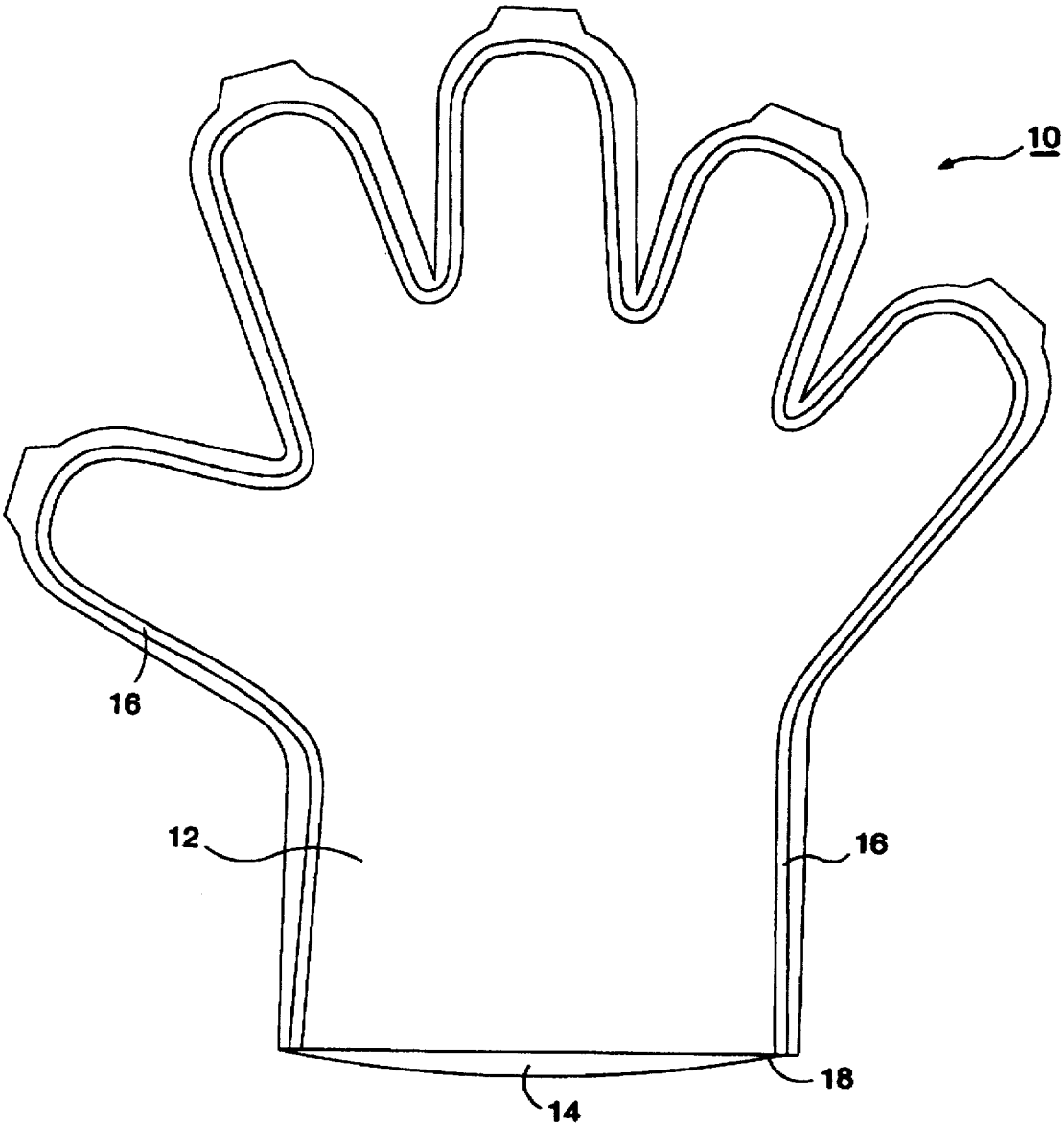
FIG. 1 is a plan view of a glove incorporating the present invention.

Shown in FIG. 1 is a protective cover of the present invention in the form of a glove 10. This glove comprises two mirror image sheets 12, 14 of composite membrane material in the approximate shape of a human hand that are bonded together along seam line 16. The seam 16 extends around most of the glove outline, with one end 18 left open for insertion of a hand or lining material.

The composite membrane material preferably comprises a porous expanded polytetrafluoroethylene (PTFE) film laminated to a backing material. The basic construction and properties of expanded PTFE are described in a number of references, including U.S. Pat. No. 3,953,566 to Gore, 3,962,153 to Gore, 4,096, 227 to Gore, and 4,187,390 to Gore, all incorporated by reference. This material comprises a microscopic matrix of polymeric nodes interconnected by fibrils. This matrix or "lattice" structure produces a unique material that has billions of micro-pores per square inch. Water droplets will not penetrate this material, but moisture vapor will. Thus, the membrane combines the divergent properties of being both waterproof and moisture vapor permeable which we refer to as "breathable."

In order to avoid compromise of the membrane from perspiration, chemicals, or other contaminants, a number of further processes have been developed to provide an oleophobic coating on the membrane. Such coatings are described in U.S. Pat. Nos. 4,194,041 to Gore et al. and PCT publication WO 90/00180 to Sakhpara, both incorporated by reference. While such coatings may somewhat diminish breathability, they are considered important for maintaining long-term durability of the membrane.

Since the membrane alone may be subject to damage or stretching and distortion, the present invention employs a composite whereby the membrane is laminated to a dimensionally stable backing material. Suitable materials include knits, lightweight multifilament knits, monofilament knits, non-woven and woven structures of nylon, polypropylene, cotton, polyester, and fire resistant fabrics.

Preferably, lamination is accomplished by adhering the backing material to the oleophobic coated PTFE film with discrete adhesive dots. A second layer of material can be laminated to the opposite side to form a 3 layer laminate. Suitable materials for this second layer include knits, lightweight multifilament knits, monofilament knits, non-woven, and woven structures of nylon, polypropylene, cotton, polyester, fire resistant fabrics.

Once the composite material is formed, the material may be cut into any desired shape and size. As has been noted, in the embodiment shown in FIG. 1, the composite material comprises two hand shaped sheets 12, 14, each a mirror image of the other, sized approximately 0 to 100% larger than the hand of the intended wearer. In order to produce a protective cover 10 of the present invention, the two sheets 12, 14 are then bonded together in a manner to produce an impenetrable seam 16 between the two sheets 12, 14. It is preferred that the backing layers are mounted facing one another for a number of reasons. First, the backing material serves to shield and protect the expanded PTFE membrane from accidental damage when the cover is donned or removed. This is particularly suitable in those instances where the cover is worn with another covering over it that will protect the expanded PTFE from external damage. Second, the backing material will more readily bond to itself using a wider variety of sealants than the expanded PTFE will bond to itself. Accordingly, it has been found that a more secure seam can be produced where a backing material to backing material interface has been formed. While this strategy of mounting backing material to backing material has proven quite effective in producing waterproof seams, seams made in this manner have failed to pass virus resistant barrier tests, as is explained in detail below.

In the course of developing the present invention, conventional seams were produced using a low pressing temperature to make 5 mm wide bead of thermoplastic polyurethane adhesive, like ESTANE, from B. F. Goodrich of Brecksville, Ohio, TEXIN from Miles, Inc. of Pittsburgh, Pa., or PELLETHANE from Dow Plastics of Midland, Mich., with viscosities less than 2000 poise at operation temperatures below 190° C. have been used successfully. The seam can be formed using bulk melter/applicators available from Meltex Corporation of Peachtree, Ga., Graco Inc. of Minneapolis, Minn., or Nordson Corporation of Atlanta, Ga. This process causes the adhesive layer to flow around the fibers of the backing material so as to produce a waterproof barrier layer. However, when this material was tested in accordance with a number of demanding leakage tests, many of the seams produced with this process failed. Although such failure was not initially understood, the reason for such failure can be appreciated through examination of scanning electron micrographs (SEMs) of these seams.

Figure 2:
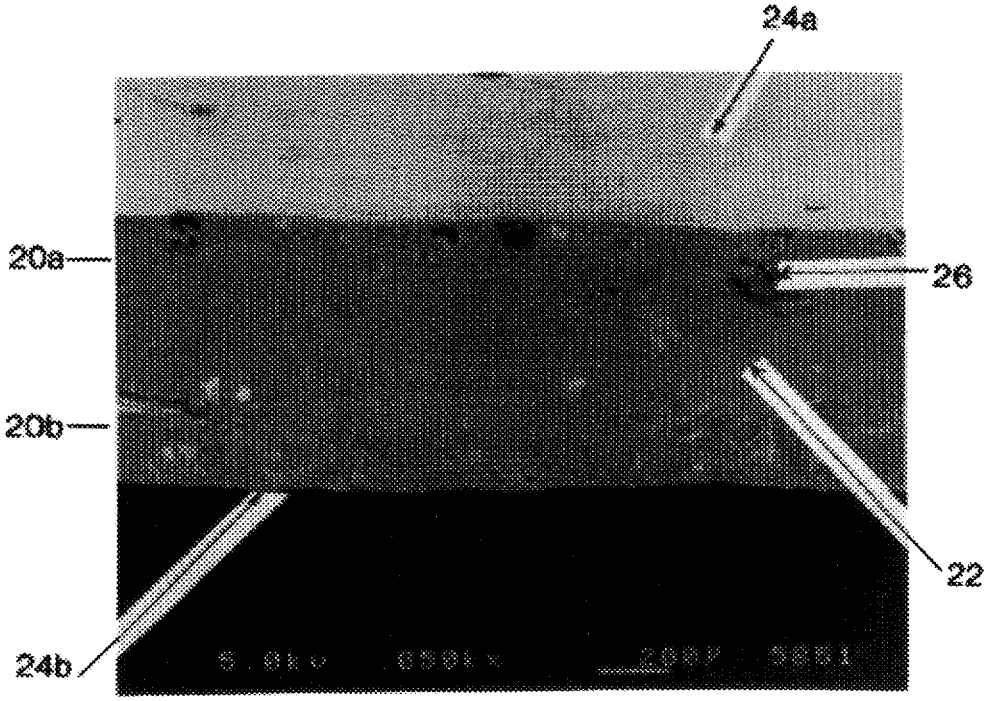
FIG. 2 is a scanning electron micrograph (SEM) enlarged 50 times of a cross-section of a seam from a commercially available glove.
Figure 3:
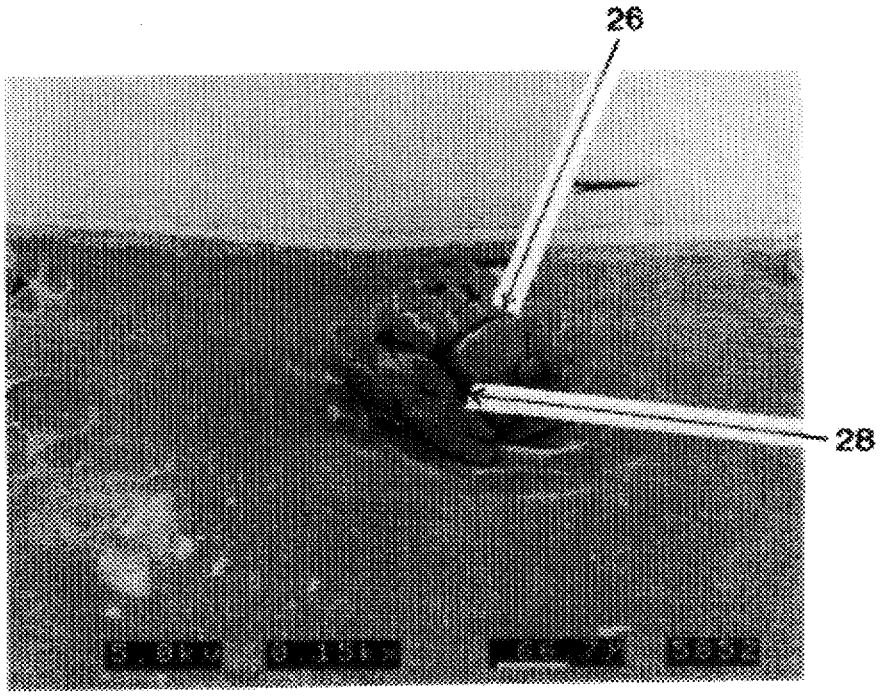
FIG. 3 is an SEM enlarged 150 times of a portion of the seam shown in FIG. 2.

FIGS. 2 and 3 are SEMs of a failed seam produced in accordance with the above described method. These seams comprise two knit backing layers 20*a*, 20*b* adhered together and permeated with an adhesive 22. The backing layers 20*a*, 20*b* are each adhered to an expanded PTFE membrane 24*a*, 24*b*. Numerous fiber bundles 26 run through the backing layer 20 and these are surrounded by the adhesive material. Unfortunately, as can be better seen in the SEM of FIG. 3, the adhesive layer fails to permeate inside of the fiber bundle 26, providing a microscopic passageway 28 through the seam. These voids are approximately 15 to 20 or more microns in diameter. Although factors such as surface tension and a tortuous pathway may prevent water from readily permeating through the seam via these passageways in a conventional dunk test, it is believed that given enough time or small enough contaminants (e.g., viruses suspended in a body fluid simulant) the protective barrier can be compromised by permeation of these gaps in the seams.

To address this concern, the present invention produces a seam in a significantly different manner. In the present invention, seams are produced using a higher pressing temperature for a continuous bead of adhesive. Suitable adhesives for use with the present invention include: ESTANE, TEXIN, PELLETHANE, MORTHANE from Morton International of Reading, Pa.; or thermoplastic polyurethane; or MOR-AD from Morton, SUPER GRIP from Bostik of Middleton, Mass., JOWATHERM from Jowat Corp. of High Point, N.C.; IPATHERM from H. B. Fuller Company of St. Paul, Minn.; or moisture curing hot melt compositions.

The seam is formed by applying a thermoplastic polyurethane to the fabric side of the bottom layer. A second layer is then placed on top of the bottom layer and adhesive with the fabric side down. The package is then placed into a heated press at least 190° C. for at least 2 seconds, and preferably at 200° C. for 3–5 seconds. The sealed package is then cut into the shape of a glove insert. Typical seam width comprises 1.5 to 5 mm and preferably 2.5 to 3.5 mm. Alternatively, the seam may be formed by applying a moisture curing hot melt composition and pressing at least 100° C. for at least 2 seconds, and preferably at 125°–150° C. for about 3–5 seconds.

Preferably, a pressure is applied to the material during this process of at least 200 lbs/in$^2$ gauge. The preferred pressure is 300 to 400 lbs/in$^2$ or above.

This process causes the adhesive layer to flow around the fibers of the backing material so as to produce a highly permeation resistant barrier layer. Suitable knit backing materials include polyester warp knits and nylon warp knits from Native Textiles of Glens Falls, N.Y., or circular polyester knits and nylon knits from Milliken Chemical Div., Milliken & Co., of Spartanburg, S.C. Moreover, the adhesive also flows into the interior of the fiber bundles so to constrict or eliminate passageways through the seam (i.e., reducing voids through the material to less than 10 micron in diameter; and preferably less than 5 micron in diameter). This process is referred to as "fully encapsulating" the fibers.

Figure 4:
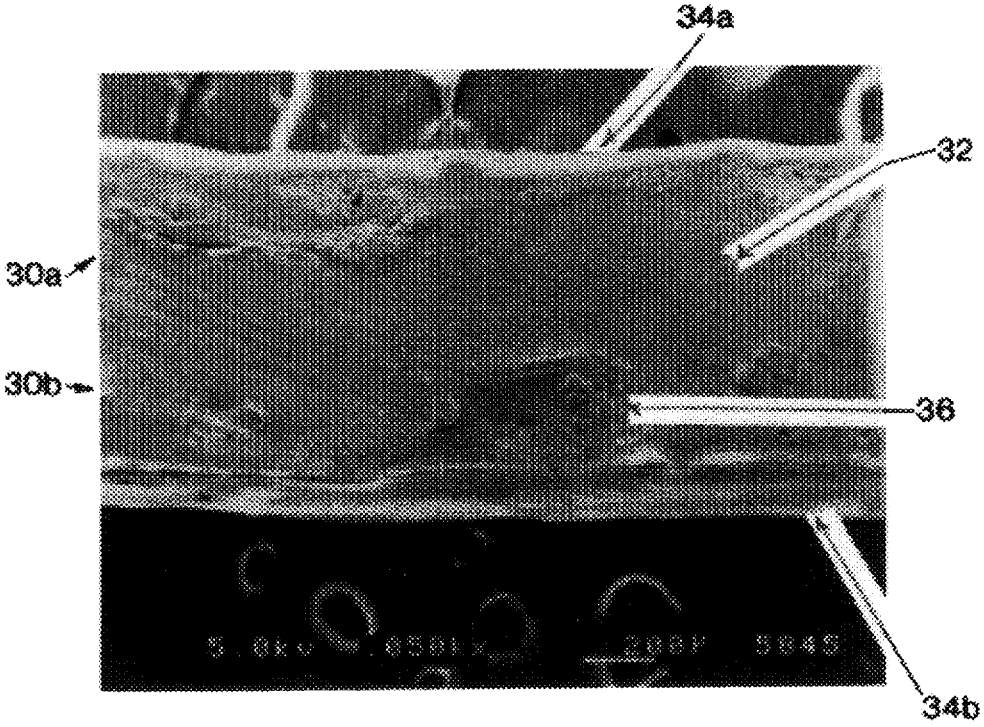
FIG. 4 is an SEM enlarged 50 times of a cross-section of a seam from one embodiment of a glove of the present invention.
Figure 5:
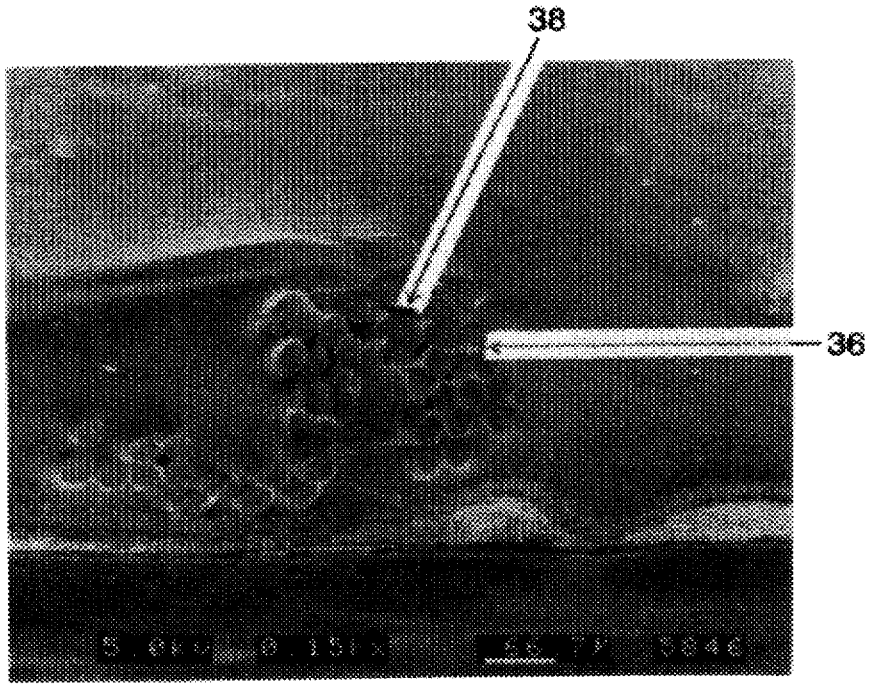
FIG. 5 is an SEM enlarged 150 of a portion of the seam shown in FIG. 4.

The improved seams of the present invention can be seen in the SEMs of FIGS. 4 and 5. Two knit backing layers 30*a*, 30*b* are again bonded together and permeated with a continuous adhesive layer 32. Each backing layer 30*a*, 30*b* is adhered to an expanded PTFE membrane 34*a*, 34*b*. Numerous fiber bundles 36 run through the backing layers 30*a*, 30*b* and these are surrounded by the adhesive material. Unlike conventional seams, however, the adhesive layer fully permeates inside of the fiber bundles 36, fully encapsulating the fibers so as to eliminate or greatly reduce the passageways 38 through the seam to the order of less than 10 micron in diameter. The result of this procedure is the creation of seams that will consistently resist the passage of air, moisture and microscopic contaminants.

Similar exceptional results may also be achieved through the processing of a non-woven backing material in accordance with the present invention. Suitable non-woven backing materials include spun bonded and meltblown materials from Fiberweb North America, Inc. of Simpsonville, S.C. These materials may be filled with adhesive in the same manner previously described. Preferably, the process for adhesive application of a non-woven material comprises:

The seam is formed by applying a thermoplastic polyurethane to the fabric side of the bottom layer. A second layer is then placed on top of the bottom layer and adhesive with the fabric side down. The package is then placed into a heated press at least 190° C. for at least 2 seconds, and preferably at 200° C. for 3–5 seconds. The sealed package is then cut into the desired shape, e.g., as a glove insert. Typical seam width comprises 1.5 to 5 mm and preferably 2.5 to 3.5 mm. Alternatively, the seam may be formed by applying a moisture curing hot melt composition and pressing at least 100° C. for at least 2 seconds, and preferably at 125°–150° C. for 3–5 seconds.

Preferably, a pressure is applied to the material during this process of at least 200 lbs/in$^2$ gauge. The preferred pressure is 300 to 400 lbs/in$^2$ or above.

Figure 6:
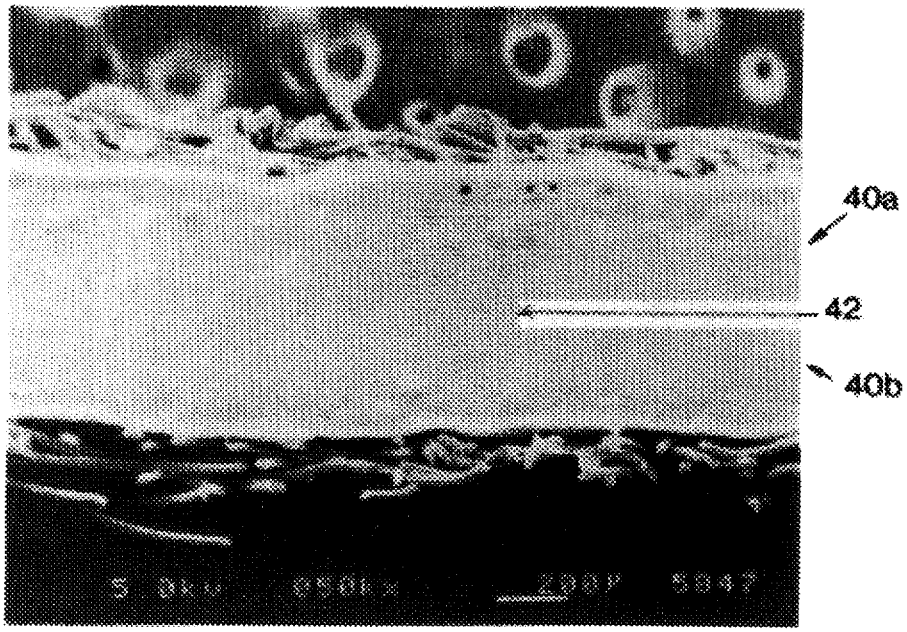
FIG. 6 is an SEM enlarged 50 times of a cross-section of a seam from another embodiment of a glove of the present invention.
Figure 7:
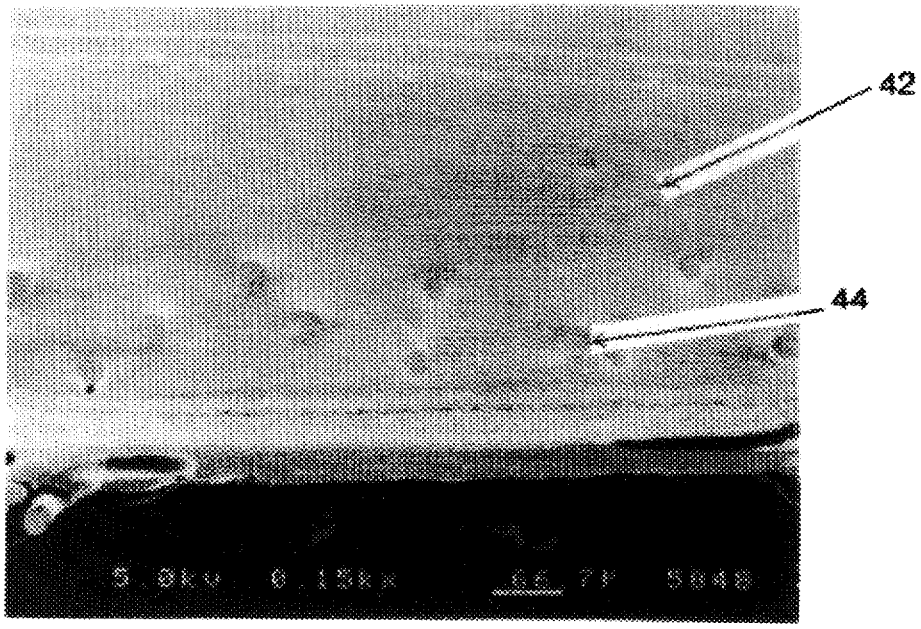
FIG. 7 is an SEM enlarged 150 times of a portion of the seam shown in FIG. 6.

As is shown in FIGS. 6 and 7, when a seam is made in this manner, each layer of backing material 40*a*, 40*b* is bonded to each other by adhesive 42. The adhesive 42 completely fills in between fibers 44 in the non-woven and seals against any leakage that might otherwise occur through the seam. Once fully encapsulated in this manner, any voids remaining through the seam comprise less than 10 micron in diameter. More preferably, voids left through the seam are maintained at a level of less than 5 micron in diameter.

Exceptional results may also be achieved through the processing of a woven backing material in accordance with the present invention. Suitable woven backing materials include woven polyester and woven nylons available from Milliken Chemical Div., Milliken & Co., of Spartanburg, S.C.

It should be understood that the present invention may be practiced with a wide variety of protective cover constructions. Possible applications include: gloves, glove inserts, booties, boot inserts, pants, waders, jackets, coveralls, masks, equipment covers, bags, tubes, socks, pouches. Such covers may be constructed from two or more separate pieces of fabric or fabrics (with either all or only some of the fabric being composite fabric of the present invention) with segments of each of the fabric pieces joined to each other with seams made in accordance with the present invention. Additionally, or alternatively, a single fabric piece may be joined to itself at two different segments using a seam of the present invention.

It is contemplated to be within the scope of the present invention to employ it with any form of breathable fabric laminates. In addition to coated or uncoated expanded PTFE laminates, other breathable and liquid resistant laminate materials that may be employed with the present invention include continuous polyurethane sheets.

Without intending to limit the scope of the present invention, the following examples illustrate how the present invention may be made and used:

EXAMPLE 1

Two layers of a spun bonded nylon non-woven laminate structure are used to construct an adhesive sealed insert. A thermoplastic polyurethane adhesive for the seam is heated to 200° C. and applied in the shape of a glove hand to the bottom layer of laminate structure on the non-woven side. A top layer of the laminate structure is laid on top of the adhesive such that the non-woven side is facing towards the adhesive. Pressure and heat are applied to the two layers of laminate structure and the adhesive so that the adhesive will encapsulate the fibers of the non-woven. The pressure is 400 lbs/in.$^2$ gauge and the heat is 200° C. The heat and pressure are applied for a time period of 3 seconds. The sealed laminate structures are then cut out around the periphery of the adhesive seam. Cutting is performed by stamping the laminate structures with a steel rule die. The finished product is an insert sealed in the shape of a glove hand.

EXAMPLE 2

Two layers of the nylon warp knit laminate structure are then used to construct an adhesive sealed insert. The moisture curing hot melt adhesive for the seam is heated to 150° C. applied in the shape of a glove hand to the bottom layer of laminate on the knit side. A top layer of the laminate structure is laid on top of the adhesive such that the knit is facing towards the adhesive. Pressure and heat are applied to the two layers of laminate structure. The pressure is 400 lbs/in.$^2$ gauge and the heat is 125° C. The heat and pressure are applied for a time period of approximately 3 seconds. The sealed laminate structures are then cut out around the periphery of the adhesive seal. Cutting is performed by stamping the laminate structures with a steel rule die. The finished product is an insert sealed in the shape of a glove hand.

EXAMPLE 3

Two layers of the nylon warp knit laminate structure are then used to construct an adhesive sealed insert. The adhesive for the seam is heated to 200° C. for a thermoplastic polyurethane and applied in the shape of a glove hand to the bottom layer of laminate on the knit side. A top layer of the laminate structure is laid on top of the adhesive such that the knit is facing towards he adhesive. Pressure and heat are applied to the two layers of laminate structure. The pressure is 400 lbs/in.$^2$ gauge and the heat is 200° C. The heat and pressure are applied for a time period of approximately 3 seconds. The sealed laminate structures are then cut out around the periphery of the adhesive seal. Cutting is performed by stamping the laminate structures with a steel rule die. The finished product is an insert sealed in the shape of a glove hand.

EXAMPLE 4

Two layers of a three layer spun bonded nylon non-woven laminate structure are used to construct an adhesive sealed insert. The three layers consisted of two layers of non-woven laminated to each side of the oleophobic coated PTFE film. The moisture curing hot melt adhesive for the seam is heated to 150° C. and applied in the shape of a glove hand to the bottom layer of laminate structure on the non-woven side. A top layer of the laminate structure is laid on top of the adhesive such that the non-woven side is facing towards the adhesive. Pressure and heat are applied to the two layers of laminate structure and the adhesive so that the adhesive will encapsulate the fibers of the non-woven. The pressure is 400 lbs/in.$^2$ gauge and the heat is 150° C. The heat and pressure are applied for a time period of 4 seconds. The sealed laminate structures are then cut out around the periphery of the adhesive seam. Cutting is performed by stamping the laminate structures with a steel rule die. The finished product is an insert sealed in the shape of a glove hand.

The success of the seams made in accordance with the present invention may be better understood by reviewing the tests as set forth below, and through comparative test results.

Whole Glove Integrity Testing

The Whole Glove Integrity Test is set forth in American National Standard Institutes (ANSI)/National Fire Protection Association (NFPA) Standard 1973, 1993 edition, "Gloves for Structural Fire Fighting," Chapter 5–12. This test consists of dunking an insert or specimen in a five gallon bucket filled with four inches of treated water. The treatment is a surfactant to lower the surface tension of the water. 7.57 ml of the surfactant, a SURFYNOL 104H from Air Products and Chemicals, Inc., Allentown, Pa., or TRITON X305 from Rohm & Heas Co., Philadelphia, Pa., is added to 2 gallons of water. The specimen is placed on the tester hand and submerged into the treated water for five minutes or until a failure is detected. A failure occurs when the test hand feels wet. The time to failure and the location of the failure on the specimens recorded.

The specifics for this test are set forth below:

5-12.1 Sample specimens are preconditioned as specified in 5-1.1, and then are conditioned for dry condition as specified in 5-1.2.

5-12.1.1 A sample glove is placed on the hand of the testing person. The testing person first dons an inner glove prior to donning the sample glove.

5-12.1.2 The inner glove is constructed of a fabric that is easily water-marked to aid in detecting water.

5-12.1.3 The inner glove covers all areas of the testing person's hand.

5-12.2 The testing person immerses the sample glove in 68° F. (20° C.) treated water to within 1 in. (2.54 cm) of the top of the body of the sample glove for 5 minutes. The testing person flexes the sample glove in a fist clinching motion every 10 seconds. Water used for whole glove integrity testing contains a nonfoaming surfactant that lowers the surface tension to less that 34 dynes/cm, ±5 dynes/cm.

5-12.3 After the test exposure of 5 minutes, the testing person removes the sample glove from the water and removes the glove and the inner glove. The inner glove and the interior of the sample glove are inspected to determine a "pass" or "fail."

5.-12.3.1 The appearance of water markings on the inner glove is considered "leakage."

The Whole Glove Leak Test (WGLT)

The whole glove leak tester is a device which applies air pressure to the interior of a finished (whole) glove to detect holes in the waterproof component. This test is set forth in U.S. Pat. No. 4,776,209, incorporated by reference. Air that leaks through is seen as air bubbles coming through a water reservoir. The test is non-destructive.

Specifically, this test is performed in the following manner:

1. A tester is connected to an air supply capable of generating at least 2.0 CFM at 25 psig.

2. A glove to be tested is placed in a test cylinder with a cuff above the top edge of the glove about one inch.

3. Air is turned in at 5 psig.

4. Initial air bubbles are caused by the glove expanding in the cylinder and do not indicate a leak. Continuous bubbles for more than ten seconds indicates a leak.

This test is used by the military in MIL-G-44419, "Gloves, Men's and Women's, Intermediate Cold/Wet."

The Water Fill Test

The Water Fill Test consists of filling the insert with water and looking for leaks. This test is similar to a test used by the FDA to test latex gloves. 21 C.F.R. §800.20. An insert or article is filled to about one inch above the top of the thumb or about two inches below the top of the glove.. Once the insert is filled with water, the insert can be held by hand or pinned to a clothesline. After one minute, the operator begins to look for leaks. The time of the test can be increased as desired.

The Wicking Dye Test

The wicking test consists of dunking weighted gloves in water for a given time and then examining a water marking liner of evidence of leaks. This test is outlined below:

Step 1

Place rounded weights (like marbles) in the fingers of the insert. Approximate weight required per finger is 15 grams.

Step 2

Submerge the insert in distilled water. A dye may be added as an aid in determining leak location.

Step 3

Method of Leak Detection: A waterproof failure is determined by checking the inside of the insert with a water marking liner. The water marking material may be a cotton glove. The cotton glove is inserted into the insert after one hour. If the cotton glove shows a water mark, then the glove leaks.

To test the present invention, the wicking test time was extended to 24 hours.

| Insert Type | WGLT @ (psi) | Wicking Dye Test @ (hr) |
|---|---|---|
| Conventional ski glove insert | pass @ 4 | failed @ 1 |
| Conventional military glove insert | pass @ 8 | failed @ 1 |
| Example 1 | pass @ 14 | pass @ 24 |
| Example 2 | pass @ 14 | pass @ 24 |
| Example 3 | pass @ 14 | pass @ 24 |
| Example 4 | pass @ 14 | pass @ 24 |

As can be seen, the present invention allows the glove seams to pass air leakage tests at significantly higher pressures and provides greater liquid permeation protection over a much longer period of time.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A protective cover comprising laminate material including at least one layer of breathable and liquid resistant sheet material and at least one layer of fibrous material to which the sheet material is affixed, and including a first segment of laminate material and a second segment of laminate material;

at least one seam joining the first and second segments of the laminate material together, the laminate material oriented to adjoin a layer of fibrous material from the first segment to the layer of fibrous material from the second segment;

wherein the seam comprises a continuous layer of adhesive applied between the first and second segments of the laminate material, the adhesive fully penetrating through each layer of fibrous material to the affixed layer of the sheet material;

wherein the adhesive fully encapsulates fibers in the fibrous material layer; and wherein any voids present in a cross-section of the seam measure less than 10 micron across.

2. The cover of claim 1 wherein the sheet material comprises an expanded polytetrafluoroethylene; and the fibrous material is selected from the group of woven fabric, non-woven fabric, or knit.

3. The cover of claim 2 wherein the cover is both liquid water impermeable and water moisture vapor permeable.

4. The cover of claim 1 wherein the adhesive is selected from the group consisting of moisture curing and thermoplastic polyurethane.

5. The cover of claim 1 wherein the seam comprises a bead of adhesive material at least 1.5 to 5 mm wide.

6. The cover of claim 1 wherein the cover comprises a glove, the first segment of laminate being an outline of a hand and the second segment of laminate being a mirror image of the first segment.

7. The cover of claim 6 wherein the first segment of laminate and the second segment of laminate comprise separate sheets of material;

the seam comprises a continuous bead of adhesive material at least 1.5 mm wide; and the bead of adhesive material traces the outline of the hand so as to form a sealed pocket into which a human hand may be inserted.

8. The cover of claim 6 wherein the sheet material comprises an expanded polytetrafluoroethylene; and the fibrous material comprises a non-woven fabric.

9. The cover of claim 8 wherein the cover is both liquid water impermeable and water moisture vapor permeable.

10. The cover of claim 1 wherein any voids present in the cross-section of the seam measure less than 5 microns across.

11. A method for producing a cover in accordance with claim 1 that comprises:

providing the first segment of laminate material and the second segment of laminate material;

applying a continuous bead of adhesive to the first segment of laminate along an intended line of the seam;

mounting the first and second segments of laminate material together with their fibrous layers abutting one another;

applying heat and pressure to the seam to adhere the two segments together, the adhesive fully penetrating through each layer of fibrous material to the affixed layer of the sheet material and fully encapsulating the fibers in the fibrous material layer.

12. The method of claim 11 that further comprises:

providing an adhesive of thermoplastic polyurethane;

applying heat of at least 190° C. and pressure of at least 200 lbs/in sq gauge for a period of at least 2 seconds.

13. The method of claim 11 that further comprises:

providing an adhesive of moisture cure;

applying heat of at least 100° C. and pressure of at least 200 lbs/in sq. gauge for a period of 2 seconds.

14. The method of claim 11 that further comprises:

producing the seam wherein any voids present in a cross-section of the seam measure less than 10 microns across.

15. The method of claim 14 that further comprises:

producing the seam wherein any voids present in a cross-section of the seam measure less than 5 microns across.

* * * * *